US010760147B2

(12) United States Patent
Kim et al.

(10) Patent No.: US 10,760,147 B2
(45) Date of Patent: Sep. 1, 2020

(54) ORDERED ALLOY 690 WITH IMPROVED THERMAL CONDUCTIVITY

(71) Applicant: KOREA ATOMIC ENERGY RESEARCH INSTITUTE, Daejeon (KR)

(72) Inventors: Young-Suk Kim, Daejeon (KR); Sung-Soo Kim, Daejeon (KR); Dae-Whan Kim, Daejeon (KR)

(73) Assignee: KOREA ATOMIC ENERGY RESEARCH INSITUTE, Daejeon (KR)

( * ) Notice: Subject to any disclaimer, the term of this patent is extended or adjusted under 35 U.S.C. 154(b) by 0 days.

(21) Appl. No.: 16/408,394

(22) Filed: May 9, 2019

(65) Prior Publication Data

US 2019/0330715 A1 Oct. 31, 2019

Related U.S. Application Data

(63) Continuation-in-part of application No. 14/896,647, filed as application No. PCT/KR2014/004977 on Jun. 5, 2014, now Pat. No. 10,287,664.

(30) Foreign Application Priority Data

Jun. 7, 2013 (KR) ..... 10-2013-0065539
Jun. 3, 2014 (KR) ..... 10-2014-0067951

(51) Int. Cl.
*C21D 1/26* (2006.01)
*C22F 1/10* (2006.01)
*C22C 19/05* (2006.01)

(52) U.S. Cl.
CPC ..... *C22C 19/058* (2013.01); *C21D 1/26* (2013.01); *C22F 1/10* (2013.01)

(58) Field of Classification Search
CPC ..... C22C 19/058; C21D 1/26; C22F 1/10
USPC ..... 148/675
See application file for complete search history.

(56) References Cited

U.S. PATENT DOCUMENTS

| | | | |
|---|---|---|---|
| 4,798,633 | A | 1/1989 | Martin et al. |
| 2002/0124915 | A1 | 9/2002 | Kobayashi et al. |
| 2006/0266450 | A1 | 11/2006 | Kwon et al. |

FOREIGN PATENT DOCUMENTS

| | | | |
|---|---|---|---|
| EP | 2275583 | A1 | 1/2011 |
| JP | 2009-299120 | A | 12/2009 |
| JP | 2010-214385 | A | 9/2010 |
| KR | 10-2010-0104928 | A | 9/2010 |

(Continued)

OTHER PUBLICATIONS

English language translation of KR1020100104928 to Kim et al. Generated Dec. 6, 2017 (Year: 2017).*

(Continued)

*Primary Examiner* — Brian D Walck
(74) *Attorney, Agent, or Firm* — Knobbe Martens Olson & Bear LLP

(57) ABSTRACT

The disclose relates to ordered Alloy 690 comprising: a matrix that includes a short range order (SRO) in a state in which nickel (Ni) is enriched, and chromium (Cr) and iron (Fe) are depleted, and the ordered Alloy 690 is characterized by having excellent resistance to stress corrosion cracking and improved thermal conductivity due to agglomeration of nickel (Ni) atoms, as compared with the unordered Alloy 690.

4 Claims, 4 Drawing Sheets

(56) References Cited

FOREIGN PATENT DOCUMENTS

| | | | |
|---|---|---|---|
| KR | 10-2011-0105156 | A | 9/2011 |
| WO | 2012/121390 | A1 | 9/2012 |

OTHER PUBLICATIONS

Samantaroy, "Effect of Heat Treatment on Corrosion Behavior of Alloy 690 and Alloy 693 in Simulated Nuclear High-Level Waste Medium", Corrosion Engineering Section, vol. 68, No. 4—13 pages (Apr. 2012).

Extended European Search Report of corresponding Patent Application No. 14807433.9—6 pages (dated Feb. 3, 2017).

Kai et al., "The Effects of Heat Treatment on the Chromium Depletion, Precipitate Evolution, and Corrosion Resistance of INCONEL Alloy 690", Metallurgical and Materials Transactions A, vol. 20A—11 pages (Oct. 1989).

International Search Report of PCT/KR2014/004977, which is the parent application—4 pages (dated Sep. 30, 2014).

Kim et al., "Intergranular Stress Corrosion Cracking (IGSCC) of Alloy 600 with Cooling Rate", Proceedings of 16th International Symposium on Environmental Degradation of Materials in Nuclear Power Systems—Water Reactors (Asheville, NC, TMS, 2013)—10 pages (2013).

Sarver et al., "Carbide Precipitation and SCC Behavior of Inconel Alloy 690", NACE, vol. 44, No. 5—2 pages (May 1988).

* cited by examiner

ORDERED ALLOY 690 WITH IMPROVED THERMAL CONDUCTIVITY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

TECHNICAL FIELD

The disclosure relates to ordered Alloy 690 with improved thermal conductivity, which can be used for steam generator tubes that function as a heat exchanger in nuclear power plants.

BACKGROUND ART

Steam generator tubes of nuclear power plants are a heat exchanger which transfers heat from the primary coolant loop to the secondary one to produce steam in the latter. At an early stage of the nuclear industry, Alloy 600 was mostly used as steam generator tubes but with increasing plant operation time, Alloy 600 is well-known to be very susceptible to primary water stress corrosion cracking (PWSCC) (see Korean Laid-open Patent Publication No. 10-2010-0104928). To overcome this problem, Alloy 690 containing a higher content of Cr than Alloy 600 has recently been used as steam generator tubes, instead of Alloy 600, because Alloy 690 is well-known to be much higher resistant to PWSCC than Alloy 600.

Alloy 600 is a Ni-base alloy with a composition in weight percent of 14-17% Cr, 6-10% Fe, 0.15% C max, 1% Mn max, 0.5% Si max, 0.015% S max, and 0.5% by mass of Cu max, and Alloy 690 is a Ni-base alloy with a composition in weight percent of 27-31% Cr, 7-11% Fe, 0.05% C max, 0.5% Mn max, 0.5% Si max, 0.5% Cu max, and 0.015% S max.

As described above, Alloy 690 is a material with a higher Cr concentration than Alloy 600, which was called "Inconel Alloy 690," after the name of the developer, or the Inco Alloys International. Inc. but is now called "Alloy 690" due to the expiration of the patent.

PRIOR ART LITERATURE

Patent Literature

Korean Patent Publication No. 10-2010-0104928

SUMMARY

In order to achieve improvement of a thermal conductivity, one aspect of the present invention provides ordered Alloy 690, comprising a matrix that includes a short range order (SRO) in a state in which nickel (Ni) is enriched, and chromium (Cr) and iron (Fe) are depleted, and the like.

Another aspect of the present invention provides ordered Alloy 690, comprising a matrix that includes a short range order (SRO) in a state in which nickel (Ni) is enriched, and chromium (Cr) and iron (Fe) are depleted.

The ordered Alloy 690 according to embodiments of the present invention comprises a matrix that includes a short range order (SRO) in a state in which nickel (Ni) is enriched and chromium (Cr) and iron (Fe) are depleted, and thus is characterized by having excellent resistance to stress corrosion cracking and improved thermal conductivity due to agglomeration of nickel (Ni) atoms, as compared with the unordered Alloy 690. Moreover, the ordered Alloy 690 has high-temperature mechanical properties and hardness which are equal to or greater than those of the unordered Alloy 690.

MODES OF THE INVENTION

Figure 1:
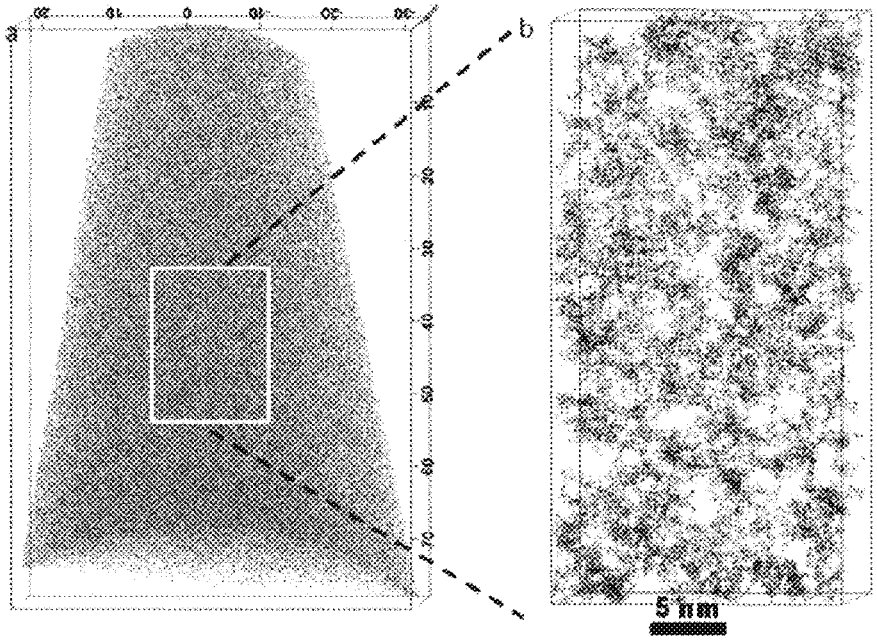
FIG. 1 illustrates the SRO formed in the ordered Alloy 690 produced in Example 1 which was analyzed with atom probe tomography.

During attempting to improve a thermal conductivity of unordered Alloy 690, the present inventors for the first time have identified a creative idea, through atom probe tomography, that a short range order (SRO) in a state in which Ni is enriched can be formed by applying an ordering treatment to induce agglomeration of Ni atoms, and therefore, have completed the present invention.

Hereinafter, the embodiments of the present invention will be described in detail.

Ordered Alloy 690 with Improved Thermal Conductivity

An embodiment of the present invention provides ordered Alloy 690, comprising a matrix that includes a short range order (SRO) in a state in which nickel (Ni) is enriched and chromium (Cr) and iron (Fe) are depleted.

That is, to improve thermal conductivity of unordered Alloy 690, the ordered Alloy 690 is characterized by comprising a matrix that includes a short range order in a state in which Ni is enriched, unlike the unordered Alloy 690.

In other words, the ordered Alloy 690 and the unordered Alloy 690 have the same total nickel (Ni) content; however, the ordered Alloy 690 is characterized by having improved thermal conductivity as compared with the unordered Alloy 690 because agglomeration of Ni atoms is induced by chemical bonding of the Ni atoms in the ordered Alloy 690. Therefore, nickel (Ni) atoms play an important role in improving a thermal conductivity; and in order to improve the thermal conductivity, it is preferable that Ni atoms be present in a state in which agglomeration of the Ni atoms is induced, despite its content of nickel (Ni) atoms being the same.

First, "ordered Alloy 690" in the present specification is meant an alloy obtained by essentially subjecting, to an ordering treatment at a temperature of 350° C. to 570° C. for 1 to 16,000 hours, commercial Alloy 690 or Alloy 690 given the same treatment as commercial Alloy 690 (solution annealing, thermal treatment, cold working, or the like).

Specifically, the ordered Alloy 690 may be produced by, but not limited to, i) a solution annealing, ii) a thermal treatment at a temperature of 700° C. to 750° C. for 15 to 24 hours, and iii) an ordering treatment at a temperature of 350° C. to 570° C. for 1 to 16,000 hours. Between Step (ii) and Step (iii), a cold working to 5% to 80% may be performed as Step (iv), and a cooling step may be added between the respective steps.

More specifically, i) the "solution annealing" is a process for homogenizing the entire chemical composition of the matrix including carbon by dissolving carbides precipitated in commercial Alloy 690. Subsequently, quenching (water cooling) may be performed so that such carbides are not precipitated during cooling.

ii) The "thermal treatment at a temperature of 700° C. to 750° C. for 15 to 24 hours" is intended to form carbides in the solution-annealed Alloy 690 so as to decrease the concentration of dissolved carbon in the matrix, thereby promoting an ordering process to be carried out subsequently.

iii) The "ordering treatment at a temperature of 350° C. to 570° C. (preferably a temperature of 400° C. to 520° C.) for 1 to 16,000 hours" is a process for promoting an ordering process to increase a degree of atomic order. As a result, improved thermal conductivity can be achieved.

Optionally, the "cold working to 5% to 80%" is a process for promoting an ordering process in the course of the ordering treatment by applying plastic deformation to metals at a temperature considerably lower than the recrystallization temperature, so as to obtain a high degree of atomic order. Here, in a case where the cold working rate is less than 5%, the cold working effect to promote the rate of ordering is very insignificant during the ordering treatment. In a case where the cold working rate exceeds 80%, there is a problem that cracking may occur during the cold working process.

Meanwhile, "unordered Alloy 690" in the present specification is meant a not only commercial Alloy 690 but also an alloy obtained by subjecting the commercial Alloy 690 to a specific treatment (solution annealing, thermal treatment, cold working, or the like), for which, however, the ordering treatment at a temperature of 350° C. to 570° C. for 1 to 16,000 hours is omitted.

In addition, "short range order (SRO)" in the present specification is intended to mean that solute atoms bond together to form their regular arrangement over a short distance with several atom spacing but their regularity does not persists over a long distance. As a result, the formation of such a short range order leads to non-uniform chemical composition of an alloy and a change in its properties.

The ordered Alloy 690 according to an embodiment of the present invention comprises the matrix with a short range order in which its density may range from 0.0010/nm$^3$ to 0.0500/nm$^3$, and preferably the density range from 0.0100/nm$^3$ to 0.0200/nm$^3$, but not limited thereto. Here, when the number density of short range order formed in the matrix is too low, the level of improvement in thermal conductivity and resistance to stress corrosion cracking seems to be negligible.

The short range order is characterized by being in a state in which nickel (Ni) is enriched due to, agglomeration of nickel (Ni) atoms induced by chemical bonding of the nickel (Ni) atoms. Due to the presence of the short range order with enriched nickel (Ni), excellent resistance to stress corrosion cracking can be maintained along with improved thermal conductivity. Here, the higher the content of enriched nickel (Ni) in the short range order (that is, the more nickel (Ni) atoms are present in a state in which agglomeration among the nickel (Ni) atoms is induced), the higher the thermal conductivity increase rate.

Specifically, as the content of the enriched nickel (Ni) may be increased by 2% by atomic weight or higher as compared with the content of nickel (Ni) before the ordering treatment, then, the thermal conductivity at 300° C. of the ordered Alloy 690 may be improved by 8% or higher as compared with the unordered Alloy 690.

In addition, the short range order may be in a state with depletions of chromium (Cr) and iron (Fe). On the contrary, the other regions of the matrix without the SRO in the ordered Alloy 690 are in a state in which nickel (Ni) is depleted and chromium (Cr) and iron (Fe) are enriched. Consequently, the ordered Alloy 690 may keep a non-uniform distribution of chemical composition as a whole.

Specifically, the short range order may contain 65% to 85% by atomic weight of nickel (Ni); 8% to 28% by atomic weight of chromium (Cr); and 2% to 8% by atomic weight of iron (Fe), which can improve a high-temperature thermal conductivity at 300° C. of the ordered Alloy 690 by 30% or higher as compared with unordered Alloy 690. The short range order preferably contains 77% to 82% by atomic weight of nickel (Ni); 12% to 17% by atomic weight of chromium (Cr); and 2% to 5% by atomic weight of iron (Fe), but not limited thereto. This can improve a high-temperature thermal conductivity at 300° C. of the ordered Alloy 690 by 90% or higher as compared with the unordered Alloy 690.

In addition, the short range order may further contain, in an amount of greater than 0% to 3% by atomic weight, one or more atoms selected from the group consisting of manganese (Mn), aluminum (Al), silicon (Si), carbon (C), sulfur (S), and copper (Cu).

As described above, the ordered Alloy 690 according to the present invention comprises the matrix that includes a short range order (SRO) with enriched nickel (Ni), and thus is characterized by having excellent resistance to stress corrosion cracking and improved thermal conductivity as compared with the unordered Alloy 690.

On the other hand, since the unordered Alloy 690 does not substantially include, in the matrix, a short range order (SRO) with enriched nickel (Ni), there is a limitation that the thermal conductivity is not sufficiently improved.

Specifically, the ordered Alloy 690 may have a high-temperature thermal conductivity at 300° C. which is increased by 8% or higher, preferably by 30% to 200%, and more preferably by 90% to 200%, as compared with the unordered Alloy 690, but not limited thereto.

In addition, the ordered Alloy 690 may have a measured crack length of 1,000 μm/mm$^2$ or shorter, and preferably of 600 μm/mm$^2$ or shorter, when deformed at a slow strain rate of $5\times10^{-8}$/s in simulated water environment (water containing 18 cc/kg $H_2$) of a nuclear power plant at 360° C. Such resistance to stress corrosion cracking can be further improved with increasing ordering treatment time.

Moreover, the ordered Alloy 690 has high-temperature mechanical properties and hardness which are equal to or greater than those of the unordered Alloy 690.

Specifically, the ordered Alloy 690 was subjected to a tensile test (for example, ASTM E8M-08) in air at 360° C. to measure the high-temperature mechanical properties. As a result, the ordered Alloy 690 may have yield strength of 150 MPa to 300 MPa, a tensile strength of 400 MPa to 600 MPa, and a total elongation of 50% to 70%.

Hereinafter, preferred examples of the present invention will be described in order to facilitate understanding of the present invention. However, the following examples are provided only for easier understanding of the present invention, and the present invention is not limited by the following examples.

EXAMPLES

Example 1

Commercial Alloy 690 was subjected to solution annealing and quenching (water cooling), and then to thermal treatment at a temperature of about 700° C. for about 17 hours and slow cooling, thereby producing TT Alloy 690. Next, the TT Alloy 690 was subjected to cold working at room temperature until a cold working rate became about 20%, thereby producing 20% CW TT Alloy 690. Then, the 20% CW TT Alloy 690 was subjected to the ordering treatment at a temperature of about 475° C. for about 3,000 hours, thereby producing ordered Alloy 690.

Comparative Example 1

Unordered Alloy 690 was produced by omitting the ordering treatment in Example 1.

For the ordered Alloy 690 produced in Example 1 and the unordered Alloy 690 produced in Comparative Example 1, a comparison was made about a total composition of alloy and the presence of a short range order (SRO). The results are shown in Table 1.

TABLE 1

| | Total composition of alloy (% by atomic weight) | Uniformity of total composition of alloy | SRO in the matrix Number (count) of SRO [Unit area: 20 × 20 × 40 nm$^3$] |
|---|---|---|---|
| Example 1 | 59Ni—31Cr—9.2Fe—0.21Mn—0.24Si—0.173C | Non-uniform chemical composition | 230 |
| Comparative Example 1 | 59Ni—31Cr—9.2Fe—0.21Mn—0.24Si—0.173C | Uniform chemical composition | 0 |

| | SRO in the matrix | |
|---|---|---|
| | Number density (count/nm$^3$) of SRO | Composition of SRO (% by atomic weight) |
| Example 1 | 0.0143 | 79.96Ni—15Cr—4Fe—0.6Mn—0.3Al—0.1Si—0.04C |
| Comparative Example 1 | 0 | — |

As shown in Table 1, the ordered Alloy 690 produced in Example 1 and the unordered Alloy 690 produced in Comparative Example 1 are found to have the same total chemical composition.

However, unlike the unordered Alloy 690 produced in Comparative Example 1, the ordered Alloy 690 produced in Example 1 is identified to have an SRO in the matrix and a non-uniform chemical composition as a whole. The chemical composition of the SRO was found to have the enrichment of Ni and depletions of Cr and Fe when compared with the overall composition of the matrix. In other words, the ordering treatment caused the SRO with enriched Ni and depleted Cr and Fe to be formed, according to the result determined with atom probe tomography which is identified in FIG. 1.

As illustrated in FIG. 1, the SRO formed in the ordered Alloy 690 produced in Example 1 was analyzed with atom probe tomography. It shows that the number of SRO formed in a white box (20×20×40 nm$^3$) was 230 in total. Thus, the number density of an SRO was calculated to be about 0.0143/nm$^3$, and the composition of the SRO was 79.96% by atomic weight of Ni; 15% by atomic weight of Cr; 4% by atomic weight of Fe; 0.6% by atomic weight of Mn; 0.3% by atomic weight of Al; 0.1% by atomic weight of Si; and 0.04% by atomic weight of C.

Figure 2A:
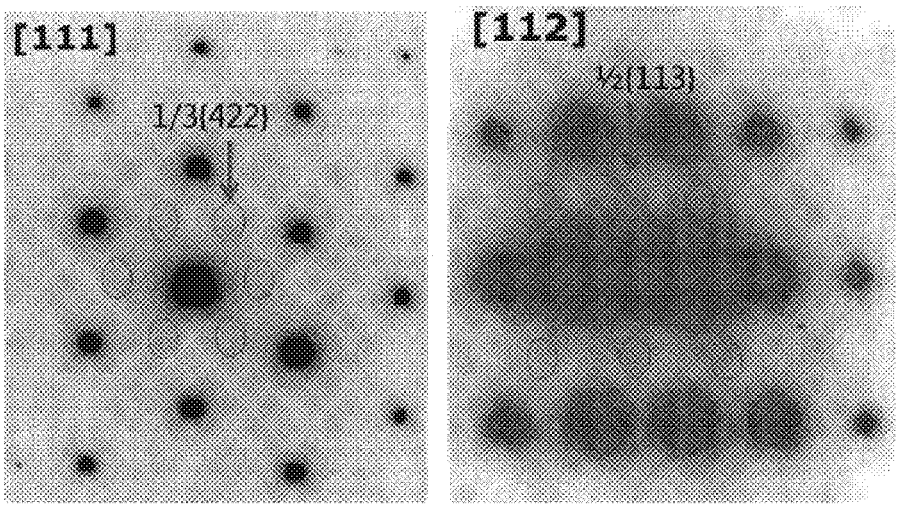
FIG. 2A illustrates the result obtained by observing, with TEM, electron diffraction patterns of the ordered Alloy 690 produced in Example 1.

In addition, FIG. 2A illustrates the result obtained by observing, with TEM, electron diffraction patterns of the ordered Alloy 690 produced in Example 1 that were obtained in the [111] and [112] zone axes. The forbidden 1/3{422} (circles) and 1/2{311} reflections (circles) which could not appear in face-centered cubic metals were observed. Given that these forbidden reflections appeared locally in a short range, the forbidden reflections shown in FIG. 2A can be treated as short-range order.

Figure 2B:
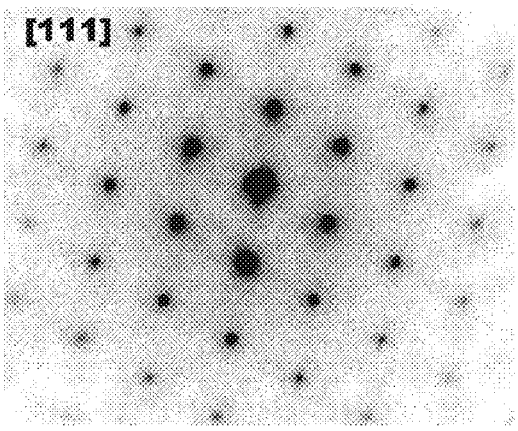
FIG. 2B illustrates the result obtained by observing, with TEM, electron diffraction pattern of the unordered Alloy 690 produced in Comparative Example 1.

On the other hand, FIG. 2B illustrates the result obtained by observing, with TEM, electron diffraction patterns of the unordered Alloy 690 produced in Comparative Example 1, indicating that the forbidden reflections appearing in the ordered Alloy 690 was not observed in the unordered Alloy 690.

Figure 3:
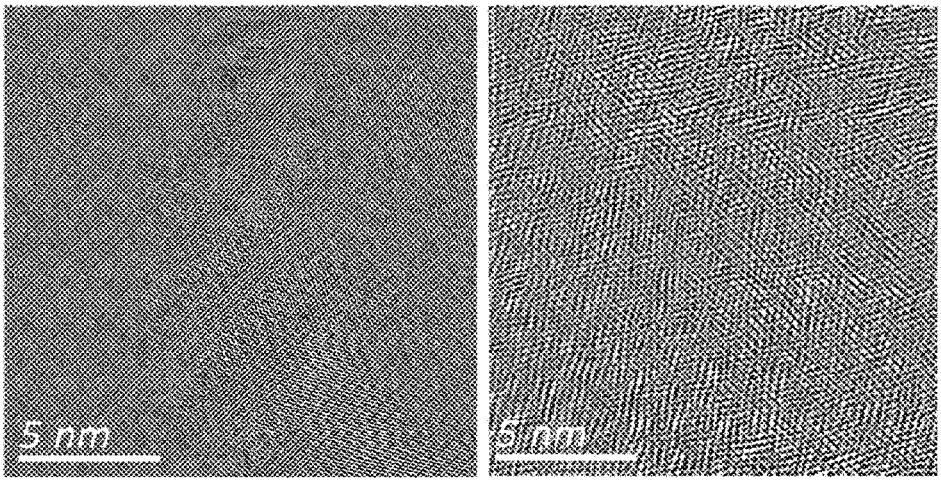
FIG. 3 illustrates the result obtained by observing, with high-resolution TEM, the lattice images of the ordered Alloy 690 produced in Example 1.

In addition, FIG. 3 illustrates the result obtained by observing, with high-resolution TEM, the lattice images of the ordered Alloy 690 produced in Example 1, in which the lattices of the matrix and the SRO are identified. Specifically, as compared with an irregular matrix, the SRO was found to have the irregularly distorted lattice with a large interplanar spacing. As such, this finding that the SRO has a lattice with a large interplanar spacing is consistent with the result of the electron diffraction pattern observed in FIG. 2. That is, the presence of the forbidden diffraction peaks inside the face-centered cubic diffraction peaks in the reciprocal lattice mode means that there exists an SRO with a large interplanar spacing.

Example 2

Commercial Alloy 690 was subjected to solution annealing and quenching (water cooling), and then to thermal treatment at a temperature of about 700° C. for about 17 hours and slow cooling, thereby producing TT Alloy 690. Next, the TT Alloy 690 was subjected to cold working at room temperature to about 40%, thereby producing 40%

CW TT Alloy 690. Then, the 40% CW TT Alloy 690 was subjected to ordering treatment at a temperature of about 400° C. for about 16,000 hours, thereby producing ordered Alloy 690.

Comparative Example 2

Unordered Alloy 690 was produced by omitting the ordering treatment in Example 2.

Figure 4:
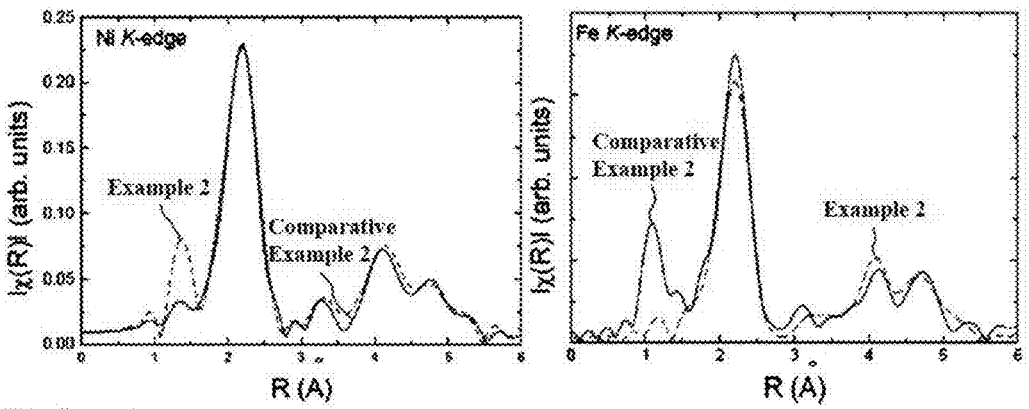
FIG. 4 illustrates Ni K-edge (left) and Fe K-edge (right) extended X-ray absorption fine structure (EXAFS) measurements at room temperature on the ordered Alloy 690 produced in Example 2 and the unordered Alloy 690 produced in Comparative Example 2, which were performed using the Pohang light source.

FIG. 4 illustrates Ni K-edge (left) and Fe K-edge (right) extended X-ray absorption fine structure (EXAFS) measurements at room temperature on the ordered Alloy 690 produced in Example 2 and the unordered Alloy 690 produced in Comparative Example 2, which were performed using the Pohang light source.

As illustrated in FIG. 4, it is identified that the ordered Alloy 690 produced in Example 2 also shows an increased Ni peak near Ni atom but shows a decreased Fe peak near Fe atom, as compared with the unordered Alloy 690 produced in Comparative Example 2. In other words, the SRO with agglomeration of Ni atoms and Fe depletion was generated in the ordered Alloy 690 during the ordering treatment, which perfectly agrees with the composition of the SRO determined by atom probe tomography, as shown in FIG. 1.

As illustrated in FIGS. 1 and 4, the SRO with agglomeration of Ni atoms to about 80% by atomic weight was significantly formed in the ordered Alloy 690 during the ordering treatment, leading to the improved thermal conductivity of the ordered Alloy 690.

Example 3

Commercial Alloy 690 was subjected to solution annealing and quenching (water cooling), and then to thermal treatment at a temperature of about 700° C. for about 17 hours and slow cooling, thereby producing TT Alloy 690. Then, the TT Alloy 690 was subjected to ordering treatment at a temperature of about 475° C. for about 3,000 hours, thereby producing ordered Alloy 690.

Comparative Example 3

Unordered Alloy 690 was produced by omitting the ordering treatment in Example 3.

For the ordered Alloy 690 produced in Example 3 and the unordered Alloy 690 produced in Comparative Example 3, high-temperature mechanical properties, thermal conductivity increase rate, resistance to stress corrosion cracking, and hardness increase rate were evaluated.

Specifically, the high-temperature mechanical properties were evaluated by measuring the yield strength, tensile strength, and total elongation using a universal testing machine (UTM-301 model, R&B Co. Ltd.) in air at 360° C. The thermal conductivity increase rate was evaluated by comparing thermal conductivities measured at 300° C. using a thermal conductivity measuring apparatus in accordance with ASTME 1225-09. In addition, the resistance to stress corrosion cracking was evaluated by a crack length measured in each alloy in a case of being deformed at a slow strain rate of $5\times10^{-8}$/s in simulated water environment (water containing 18 cc/kg $H_2$) of a nuclear power plant at 360° C. The hardness increase rate was evaluated by comparing hardness measured using a Micro-Vickers hardness tester. The evaluation results are shown in Table 2.

TABLE 2

| | Mechanical properties at high temperature | | | Thermal conductivity increase rate (%) | Resistance to stress corrosion cracking (μm/mm²) | Hardness increase rate (%) |
|---|---|---|---|---|---|---|
| | Yield strength (MPa) | Tensile strength (MPa) | Total elongation (%) | | | |
| Example 3 | 175 | 490 | 59 | 96 | 590 | 4 |
| Comparative Example 3 | 175 | 500 | 58 | 0 (basis) | 540 | 0 (basis) |

As shown in Table 2, it is identified that the ordered Alloy 690 produced in Example 3 has a thermal conductivity increase rate at 300° C. which is about 96% or higher as compared with the unordered Alloy 690 produced in Comparative Example 3. In addition, it is identified that the ordered Alloy 690 produced in Example 3 has a measured crack length of about 590 μm/mm² in a case of being deformed at a slow strain rate of $5\times10^{-8}$/s in simulated water environment (water containing 18 cc/kg $H_2$) of a nuclear power plant at 360° C. This indicates that the resistance to stress corrosion cracking of the ordered Alloy 690 produced in Example 3 is almost similar to that of the unordered Alloy 690 produced in Comparative Example 3. However, when the ordering treatment time was increased to about 10,000 hours during the production of the ordered Alloy 690 produced in Example 3, a crack length measured at the same condition as above was decreased to about 380 μm/mm², indicating that the resistance to stress corrosion cracking can be greatly improved as compared with the unordered Alloy 690 produced in Comparative Example 3.

In addition, it is identified that the ordered Alloy 690 produced in Example 3 has the high-temperature mechanical properties, such as yield strength, tensile strength, and total elongation, and hardness which are equal to or greater than the unordered Alloy 690 produced in Comparative Example 3.

The foregoing description of the present invention is provided for illustration. It will be understood by those skilled in the art that various changes and modifications can be easily made without departing from the technical spirit or essential features of the present invention. Therefore, it is to be understood that the above-described examples are illustrative in all aspects and not restrictive.

The invention claimed is:

1. Ordered Alloy 690 TT (thermal treatment), comprising:

a matrix that includes a short range order (SRO) comprising 65% to 85% by atomic weight of nickel (Ni), 8% to 28% by atomic weight of chromium (Cr), and 2% to 8% by atomic weight of iron (Fe), wherein nickel (Ni) is enriched, and chromium (Cr) and iron (Fe) are depleted in the SRO, compared to the total composition of the ordered Alloy 690 TT, wherein the ordered Alloy 690 TT has a thermal conductivity at 300° C. higher than that of unordered Alloy 690 TT by 8% or higher.

2. The ordered Alloy 690 TT according to claim 1, wherein the SRO further comprises, in an amount of greater than 0% to 3% by atomic weight, one or more atoms selected from the group consisting of manganese (Mn), aluminum (Al), silicon (Si), carbon (C), sulfur (S), and copper (Cu).

3. The ordered Alloy 690 TT according to claim 1, wherein the SRO formed in the matrix has a density of 0.0010/nm³ to 0.0500/nm³.

4. The ordered Alloy 690 TT according to claim 1, wherein the ordered Alloy 690 TT has a measured crack length of about 1,000 $\mu m/mm^2$ or shorter when deformed at a slow strain rate of $5\times10^{-8}/s$ in simulated water environment (water containing 18 cc/kg $H_2$) of a nuclear power plant at 360° C.

* * * * *